US005120094A

United States Patent [19]

Eaton et al.

[11] Patent Number: 5,120,094

[45] Date of Patent: Jun. 9, 1992

[54] SLIDING DOOR LOCKING DEVICE

[75] Inventors: Charles G. Eaton, Badger; James C. Krahn, Warroad, both of Minn.

[73] Assignee: Marvin Lumber and Cedar Co., Warroad, Minn.

[21] Appl. No.: 642,290

[22] Filed: Jan. 17, 1991

[51] Int. Cl.[5] ..... E05C 1/16

[52] U.S. Cl. ..... 292/159; 292/DIG. 46; 292/161; 292/341.14

[58] Field of Search ..... 292/DIG. 46, 156–162, 292/34, 341.14

[56] References Cited

U.S. PATENT DOCUMENTS

| | | | |
|---|---|---|---|
| 1,398,044 | 11/1921 | Sheinman | 292/161 |
| 1,438,547 | 12/1922 | O'Connor | 292/161 |
| 1,515,612 | 11/1924 | O'Connor | 292/161 |
| 2,862,378 | 12/1958 | Harris | 292/DIG. 46 |
| 2,964,344 | 12/1960 | Rich | 292/DIG. 46 |
| 3,026,702 | 3/1962 | Cary | 292/DIG. 46 |
| 3,173,716 | 3/1965 | Silvers | 292/DIG. 46 |
| 3,175,873 | 3/1965 | Blomquist et al. | 292/159 |
| 4,486,040 | 12/1984 | Strangward | 292/160 |
| 4,500,122 | 2/1985 | Douglas | 292/DIG. 46 |
| 4,937,975 | 7/1990 | Zilkna | 292/161 |

FOREIGN PATENT DOCUMENTS

| | | | |
|---|---|---|---|
| 1461604 | 12/1966 | France | 292/160 |
| 2367892 | 6/1978 | France | 292/DIG. 46 |
| 726860 | 12/1966 | Italy | 292/160 |

*Primary Examiner*—Eric K. Nicholson
*Attorney, Agent, or Firm*—Lawrence M. Nawrocki

[57] ABSTRACT

Locking apparatus for securing in a closed disposition a sliding door panel defined, in part, by a jamb-engaging stile which, when the panel is in a closed disposition, is received within a channel defined by frame members defining the jamb. The apparatus includes one or more locking bosses which are received within the channel defined by the frame members. The boss, or bosses, are recessed so that, when the panel is in an open disposition, they do not protrude out of the channel beyond the frame members which define the jamb. Further, the apparatus includes means carried by the jamb-engaging stile for capturing one or more of the locking bosses when the panel is in a closed disposition. Such capture apparatus precludes opening lateral movement of the door panel from its closed disposition.

3 Claims, 7 Drawing Sheets 26
32
30'
24
32
36
44
30
116
80
78
38
44
42
44
22
20
28
32'
34
34
30

60
62
72
78
80
82
92
98
108
44
48
52
54
56
68

SLIDING DOOR LOCKING DEVICE

TECHNICAL FIELD

The present invention deals broadly with millwork. More narrowly, however, the invention deals with a sliding door of the type known as a French door. The focus of the invention is structure employed to lock a French door against opening movement.

BACKGROUND OF THE INVENTION

Various types of sliding doors are known in the prior art. In fact, the technology of sliding doors is relatively well-known and well-developed. Such doors, which are typically known as French doors, are utilized to provide access, for example, to patios and decks. Such access is provided, typically, from residences with such patios and decks are associated.

When French doors are provided as a primary closure, for example, to a residence from a patio or a deck, special attention must be given to the manner in which the door can be locked. In the prior art, locking jaws or studs extending from a stile engaged, when the door is closed, against the jamb, have been provided. In the case of locking jaws, when the leading stile is moved to a point at which it is received within a channel defined by frame members comprising the jamb, the jaws are actuated to latch over bars or other members. Such latching precludes withdrawal of the door panel to an open disposition.

In the case of locking studs, the studs, carried by the stile of the door panel, are urged into the jamb as the door is closed. Once the door is in a closed disposition, means are actuated to effect capture of the studs to hold the door against opening.

In either case, dangerous protrusions, extending from the stile, are present which can occasion injury. Because of the nature of French doors and the fact that they are, typically, provided in locations where people frequently and quickly enter and leave, there is a tendency to be rather careless in passing through the open door.

Additionally, a frequent location of such doors is one wherein ingress and egress from and to a patio or deck is afforded thereby. People passing through such doors, therefore, are very often passing through an open French door to check on food in a barbeque or perform some other action which involves a relatively small amount of time. A person very casually exists and enters back into the house. Again, causion is rarely exercised.

Because of the protrusions which locking jaws and studs provide, injury to homeowners can, and frequently does, result. It would, therefore, be desirable to provide a locking system which is, at the same time, secure and unlikely to cause injury. Additionally, an object of a desirable system would be to minimize the damage to components of the system when effecting locking and unlocking operations.

It is to these dictates of the prior art and the problems of the prior art described above that the present invention is directed. It is a system for effecting locking of a sliding door panel which addresses these dictates and problems.

SUMMARY OF THE INVENTION

The invention is a system for locking closed a sliding door panel which has a jamb-engaging stile. When the door panel is in a closed disposition, the stile is received within a channel defined by frame members comprising the jamb. The apparatus includes at least one locking boss which is received within the channel defined by the frame members and recessed therein. The boss is recessed to a point so that, when the door panel is in an open disposition, the boss does not protrude out of the channel beyond the frame members comprising the jamb. The apparatus further includes structure carried by the stile which, when the door panel is in a closed disposition, engages and captures the locking boss to preclude lateral movement of the door panel to effect opening thereof.

It will be understood that, typically, more than one locking boss would be employed in the system. Each such boss employed, however, would be received and recessed within the channel defined by the frame members comprising the jamb. The intent would be that the multiple locking bosses be vertically spaced with respect to one another along the jamb. In an embodiment wherein multiple locking bosses are employed, the jamb-engaging stile would carry means for capturing each of locking bosses when the panel is in a closed disposition.

The preferred embodiment employs a jamb-engaging stile which has a recess formed therein, and wherein each locking boss received within the channel in the door jamb has an expanded portion at a distal end thereof. The capturing means includes a vertically-elongated panel which closes the recess formed in the jamb-engaging stile. This closure panel is provided with an aperture, in alignment with each of said locking bosses, through which each boss passes as the door panel is moved to a closed disposition.

A second panel received within the recess and engaged with the first panel is provided. The second panel is provided with an aperture to allow passage therethrough of one of said locking bosses. Each aperture includes a widened portion, through which the expanded portion of the corresponding locking boss can pass, and a narrowed portion through which the expanded portion of the corresponding locking boss is precluded from passing.

The second panel is disposed for reciprocation between first and second positions. The widened portion of an aperture is in registration with the aperture in the first panel when the second panel is in its first position. The narrowed portion of an aperture in the second panel is in registration with the aperture in the first panel when the second panel is in its second position. The apparatus includes structure for effecting movement of the second panel selectively between its first and second positions.

In one embodiment of the invention, the widened portion of each aperture in the second panel is substantially the same size and shape as a corresponding aperture in the first panel. In this embodiment, a plug, substantially the same size and shape as a corresponding aperture in the first panel and a corresponding widened portion of an aperture in the second panel, is provided. The plug is biased outwardly, when the second panel is in its first position, through the registered widened portion of the aperture in the second panel and the corresponding aperture in the first panel. As a result, movement of the second panel, relative to the first panel, is precluded.

When the door panel is moved to a closed disposition, however, the expanded portion of a locking boss will pass inwardly into the recess through the registered aperture in the first panel and the widened portion of the aperture in the second panel to overcome the biasing of the plug. Relative movement of the second panel with respect to the first panel will then be allowed.

In another embodiment of the invention, other means are provided to facilitate alignment of the aperture in the first panel and the widened portion of the aperture in the second panel when the door is opened, and preclude registration of the narrowed portion of the aperture in the second panel with the aperture in the first panel when the door panel is in an opened disposition. In this embodiment, a tab, extending from the inner surface of the second panel generally perpendicular thereto to define a plane generally parallel to an axis of elongation of the second panel, is provided. The tab mounts, generally transverse thereto, a dowel.

This embodiment also includes an ear extending from the inner surface of the first panel generally perpendicular thereto to define a plane substantially parallel to the plane defined by the tab. A cam is mounted to the ear for rotation about an axis which is spaced from the inner surface of the second panel at a distance different than that at which the dowel is spaced from the inner surface of the second panel.

The cam is provided with a generally radially-extending slot therein, and the dowel is received within the slot. As the cam is made to rotate, the dowel rides radially within the slot to drive the second panel longitudinally relative to the first panel. Typically, an operating handle would be provided to effect rotation of the cam.

In order to facilitate the alignment of apertures as previously described, one side of the slot formed in the cam, proximate an outer peripheral surface of the cam, is provided with a concave profile which generally conforms to an outer surface of the dowel. The cam is oriented relative to the ear, tab, and dowel so that, when the dowel is cradled within the concave profile provided, the second panel will be positioned longitudinally relative to the first panel so that the aperture formed in the first panel is in registration with the widened portion of the aperture formed within the second panel.

The cam would, of course, be able to be rotated to overcome the cradling of the dowel within the concave profile. When this occurs, continued rotation of the cam will effect radially inward relative movement of the dowel along the slot in the cam to accomplish movement of the second panel relative to the first. As a result, the narrowed portion of the aperture in the second panel will become registered with the aperture in the first panel, and the second panel will, thereby, "capture" the expanded portion of a locking boss.

The present invention is thus an improved locking system for French doors. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
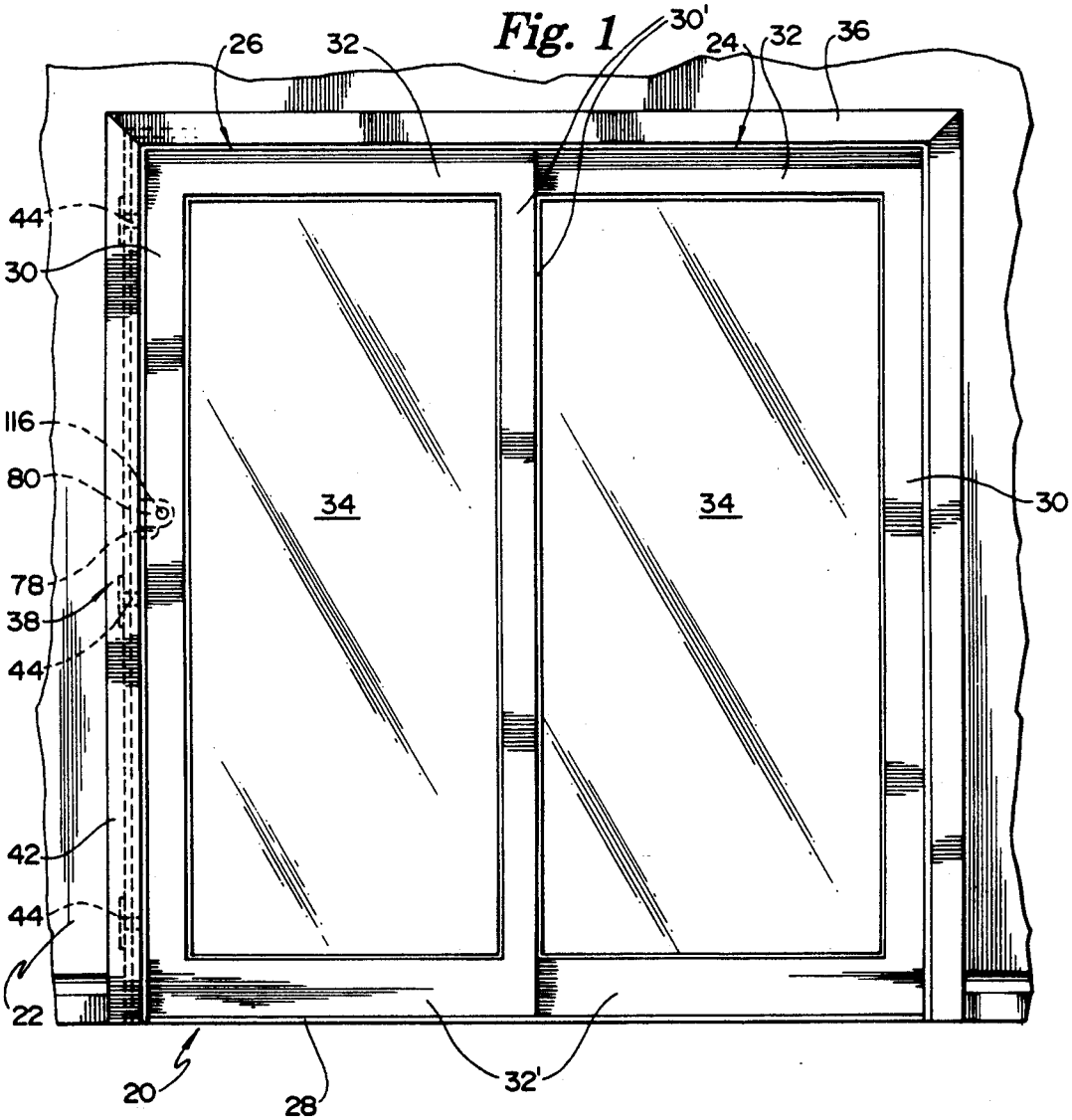
FIG. 1 is a front elevational view of a sliding door panel assembly employing locking apparatus in accordance with the present invention.

Referring now to the drawings wherein like reference numerals denote like elements through the several views, FIG. 1 illustrates a French door 20 generally of a type known in the art. The door 20 is mounted in the wall 22 of a building (typically, a residential dwelling) in order to provide ingress and egress from and to, respectively, a patio or deck (not shown). The door 20 includes a fixed panel 24 (that is, one which does not slide laterally) and a moveable panel 26 which slides along a track 28 in order to effect opening and closing of the door panel 26. Each panel 24, 26 comprises a pair of vertical frame members (stiles) 30, 30' and a pair of horizontal frame members (rails) 32, 32' with a glass sheet 34 glazed therewithin.

The frame which bounds the fixed and sliding panels 24, 26 includes a horizontal header 36. Additionally, the frame includes a jamb 38 defining a channel 40 into which the sliding panel 26 moves when being slid to a closed disposition. The sliding panel 26 interacts with the jamb 38 to effect locking of the door 20, and hardware is provided in the channel 40 formed in the jamb 38 and the stile 30 which is received within the channel 40 in the jamb 38 to effect that purpose.

The structure defined to this point is known to the prior art and is used with virtually every sliding door product ever commercially sold. It has been described, however, in order to provide a foundation for the description of the invention to be given hereinafter.

FIG. 1 illustrates hardware in accordance with the present invention shown in phantom line. The invention includes multiple embodiments of hardware, and one embodiment is illustrated in FIGS. 2–8.

Figure 9:
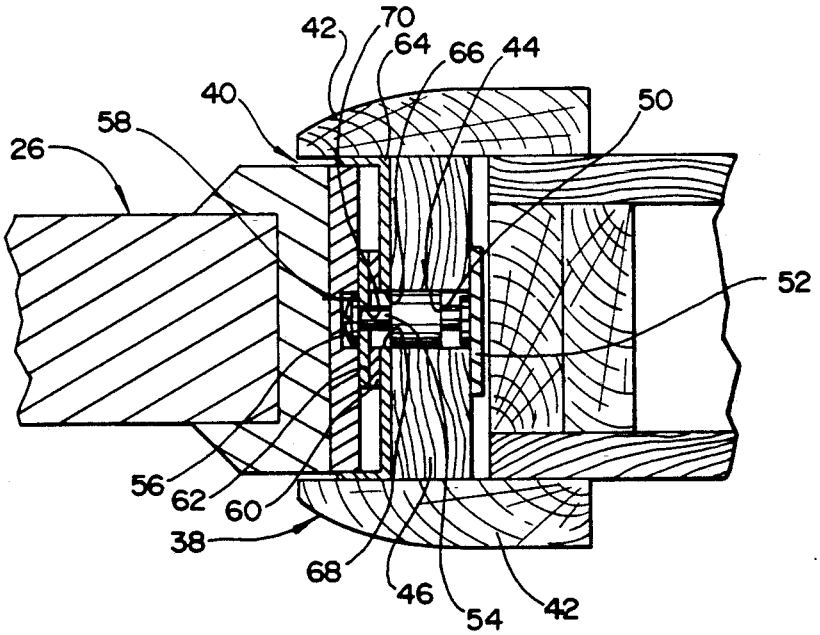
FIG. 9 is a top sectional view illustrating the door panel in a closed, locked disposition.

First, however, FIG. 9 illustrates a principle of the invention which applies to all embodiments of the hardware. That figure shows a door jamb 38 including casing panels 42 which extend laterally in the direction of the door panels 24, 26. The casing panels 42 extend one on either side of the sliding door panel 26 and sufficiently far to define the channel 40 in which the sliding door panel 26, as it is moved toward the jamb 38, is received.

A locking boss 44 is shown in place within the channel 40 generally centrally therewithin. The locking boss 44 is illustrated as extending longitudinally along an axis substantially aligned with the axis with which the sliding door panel 26 moves between its open and closed dispositions.

FIG. 9 illustrates an anchoring member 46 extending across the channel 40 defined between the casing panels 42. It is to this anchoring member 46 that the locking boss 44 is mounted. The boss 44 includes a barrel 48 which extends through an aperture 50 in the anchoring member 46. The barrel 48 is connected, by appropriate means, to a backing plate 52 which engages a rear side of the anchoring member 46. A narrowed neck 54 of the locking boss 44 extends from the barrel 48, and the distal end of the locking boss 44 terminates in an expanded head 56.

The sliding door panel 26 has a recess 58 formed in an edge thereof which is received within the jamb 38. The recess 58 is intended to receive the expanded head portion 56 of the locking boss 44. The recess 58 is closed by a first panel 60, and a second panel 62 is disposed immediately behind the first panel 60. The overall edge is covered by a jamb facing 64.

FIG. 9 illustrates the sliding door panel 26 in a locked disposition. The locking boss 44 is shown as having passed through an aperture 66 in the jamb facing 64, through an aperture 68 in the first recess closure panel 60, and through a widened portion of an aperture 70 formed in the second panel 62 immediately behind the first panel 60. The head 56 of the locking boss 44 is received within the recess 58 behind the closure panels 60, 62. With the head 56 in this position, the second panel 62 has been moved so that a narrowed portion 72 of the aperture 70 is in registration with the aperture 68 in the first panel 60. The narrowed portion 72 of the aperture 70 in the second panel 62 has a diameter smaller than that of the expanded head 56 of the locking boss 44, and, consequently, withdrawal of the door panel 26 has become precluded. It will be understood, in view of this disclosure, that locking is effected by vertical movement of the second panel 62 so as to register the narrowed portion 72 of the aperture 70 formed therein with the aperture 68 in the first panel 60.

Figure 2:
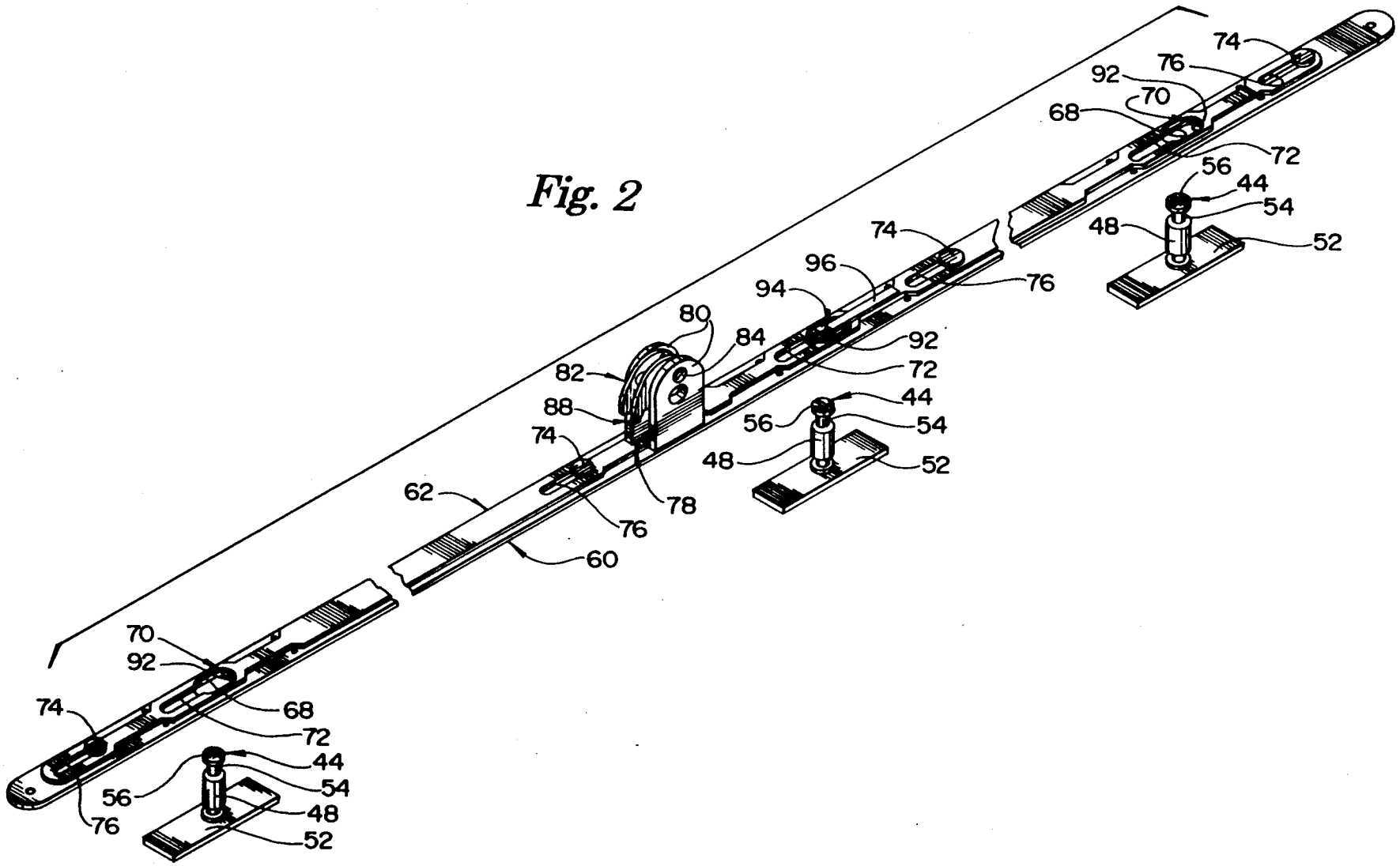
FIG. 2 is an exploded perspective view, rotated 90°, of a first embodiment of a locking mechanism in accordance with the present invention.
Figures 10, 11:
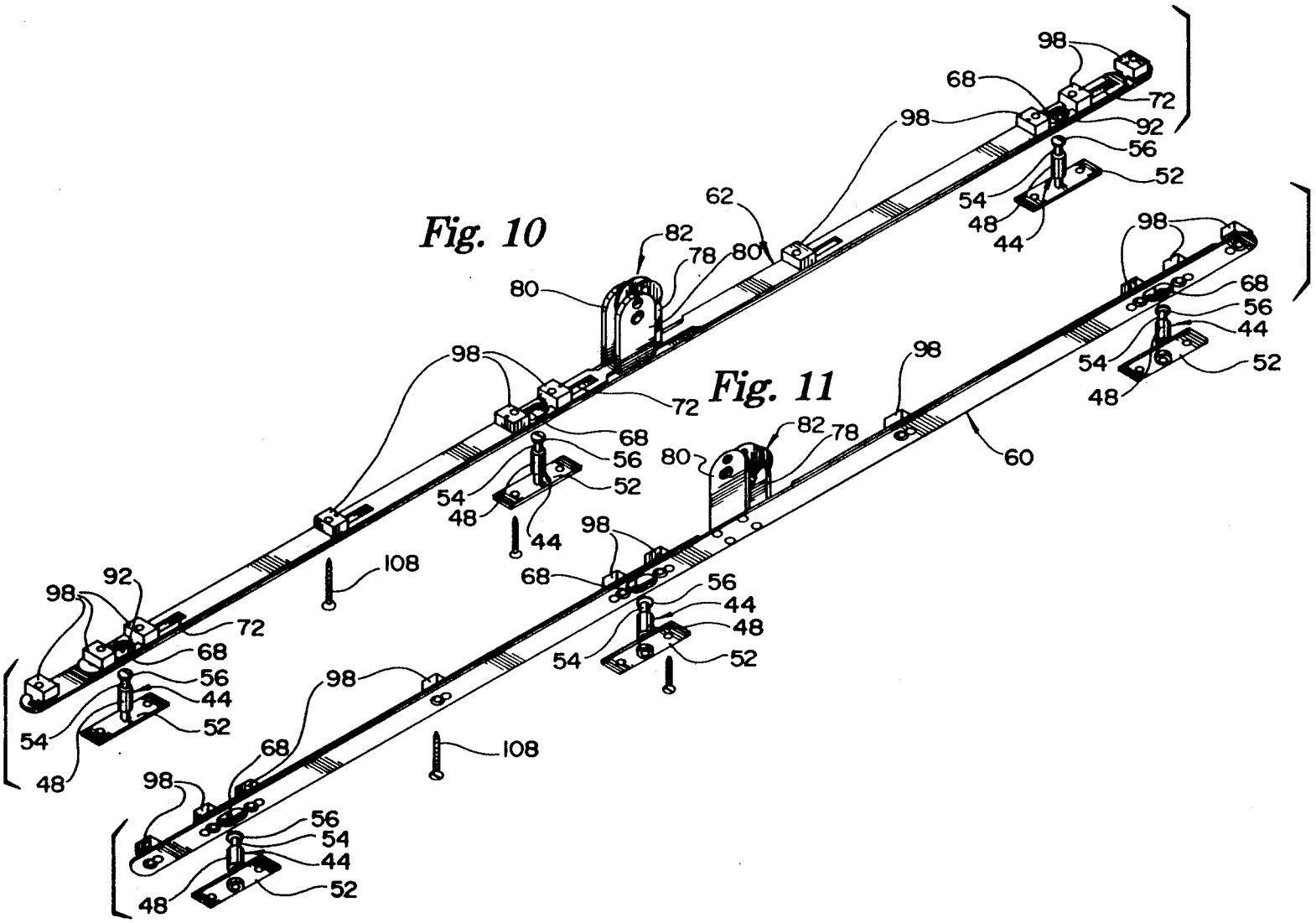
FIG. 10 is a view similar to FIG. 2, illustrating a second locking hardware embodiment.
FIG. 11 is a view of the hardware shown in FIG. 10, but from a different perspective.

While FIG. 9 illustrates a single locking boss 44, it is intended that multiple locking bosses be employed along the vertical dimension of the door jamb 38. FIGS. 2 and 10–11 illustrate such multiple bosses.

As previously indicated, FIGS. 2–8 illustrate one embodiment hardware for effecting locking of a sliding door panel 26 in a closed disposition. FIG. 2 illustrates the hardware rotated generally 90° from its operational orientation. That figure shows the first panel 60 underlying the second panel 62. As previously indicated, the first panel 60 is fixed and has no movement relative to the edge of the slidable door panel 26. On the other hand, however, the second panel 62 is disposed for longitudinal reciprocation relative to the first panel 60. As may be seen in FIG. 2, the first panel 60 includes a plurality of button head standoffs 74 extending generally perpendicular to a plane defined by said first panel 60. The button head standoffs 74 extend through button slots formed in the second panel 62. Because of the expanded nature of the button heads 74, the second panel 62 will be held against the first panel 60 but be able to reciprocate therealong.

Figure 14:
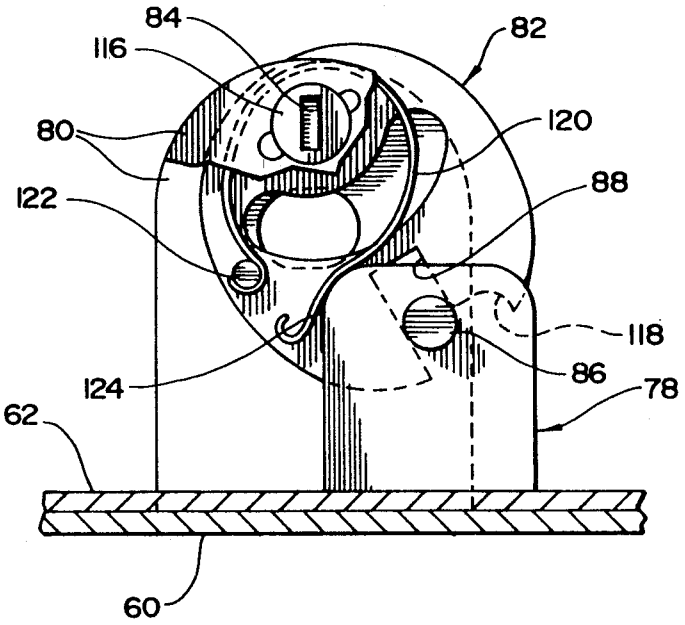
FIG. 14 is a view similar to FIG. 13, but with the locking panel in its second position.
Figure 13:
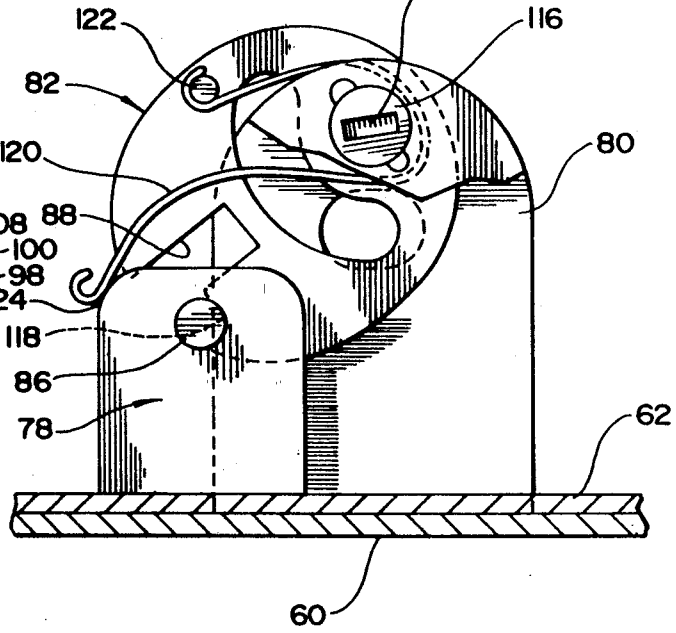
FIG. 13 is a fragmentary side elevational view of the locking hardware illustrated in FIGS. 10 and 11 with the second panel in its first position.

Movement is imparted to the second panel 62 by a cam assembly. The assembly includes a tab 78 which extends from the second panel 62 generally perpendicular to a plane defined by that panel 62. Longitudinally proximate the tab 78, but mounted to the first panel 60 and extending generally perpendicular to a plane defined by that first panel 60, are a pair of ears 80. A double plate cam 82 is mounted between the ears 80 and is disposed for rotation about an axis extending generally transverse to planes defined by the ears 80. The cam 82 is mounted to a shaft which is rotated by employment of a key (not shown) inserted into a tumbler slot 84. It will be understood that, in operation, the key would comprise an extension from an operating handle (not shown) of the door 20. The key would be inserted into the tumbler slot 84 and, as the handle were rotated, the cam 82 would also be rotated. The tab 78 mounts a dowel 86 (not shown in FIG. 2) thereon. The dowel 86 extends generally transverse the plane defined by the tab 78 and is received within a radially extending slot 88 within the cam 82. While FIGS. 13 and 14 illustrate a second embodiment of the locking hardware, the cam 82 can be constructed generally as that illustrated in FIGS. 13 and 14 in that the cam 82 shown in those figures has a radially extending slot 88 formed therein. Differences between the two embodiments, however, will become apparent with reference to the subsequent description of that embodiment.

The tab 78 and a dowel 86 carried by the tab 78 illustrated in FIGS. 13 and 14 is also similar to that of the first embodiment. The dowel 86 is disposed so that it can be received within the slot 88 of the cam 82. As will be understood in view of this disclosure, rotation of the cam 82 will effect longitudinal movement of the tab 78 as a result of the edges of the slot 88 in the cam 82 urging the dowel 86 in one or the other of opposite longitudinal directions. Consequent longitudinal movement of the second panel 62 relative to the first panel 60 will occur.

Figure 3:
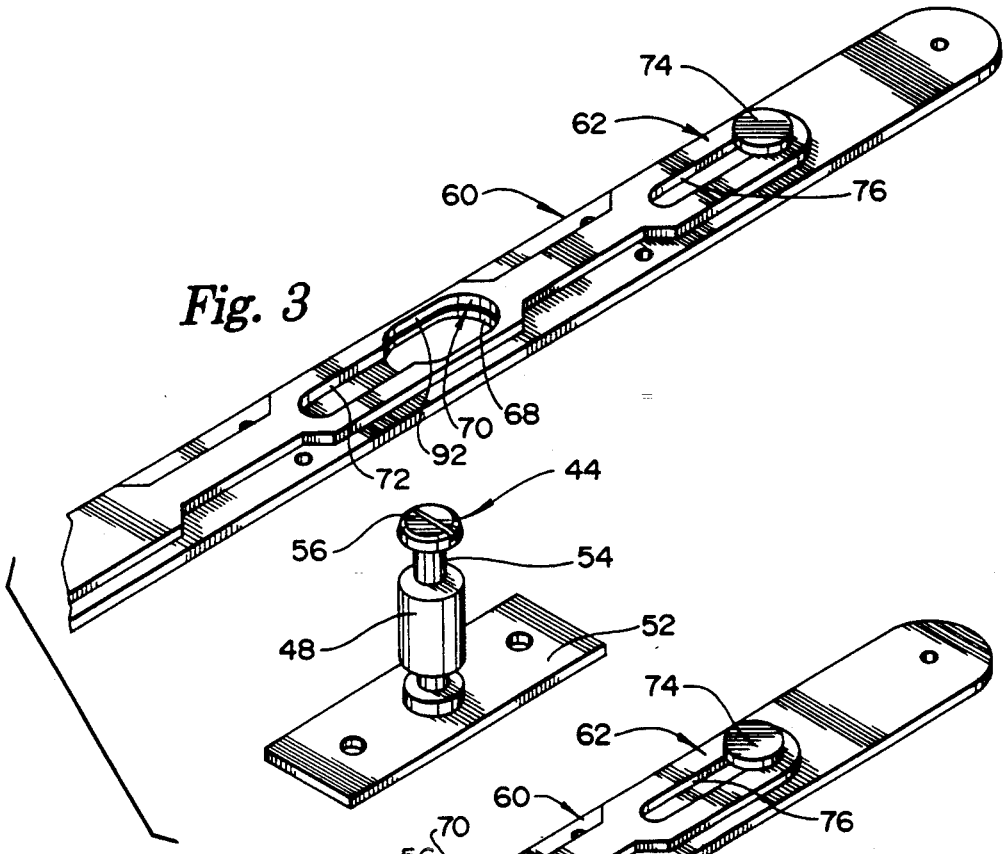
FIG. 3 is an exploded perspective view of a portion of the structure illustrated in FIG. 2, representative of an open disposition of the door panel.
Figure 4:
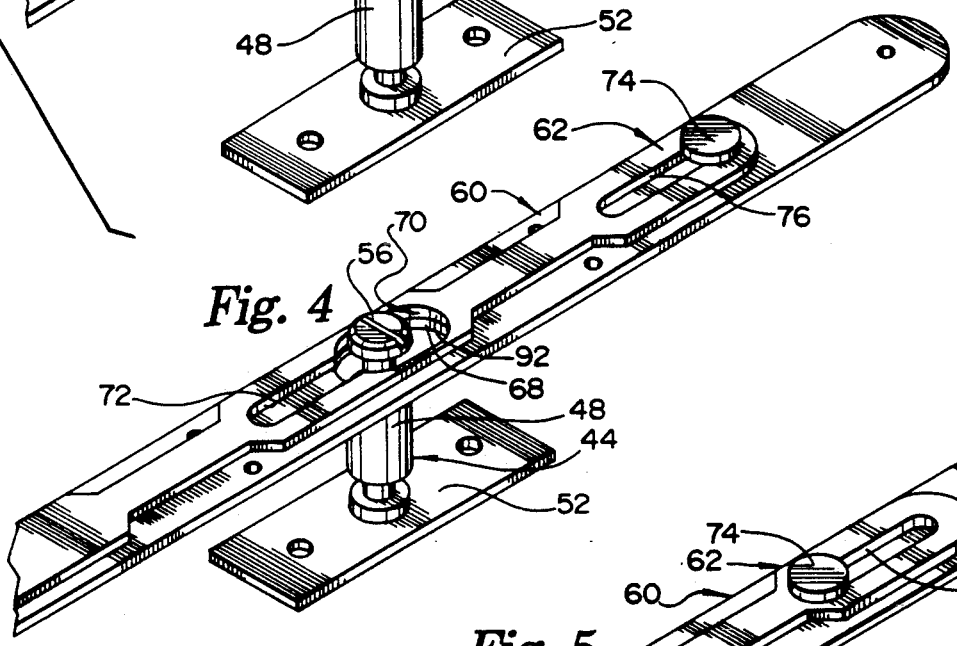
FIG. 4 is a view similar to FIG. 3, but representative of a closed, unlocked disposition of the door panel.
Figure 5:
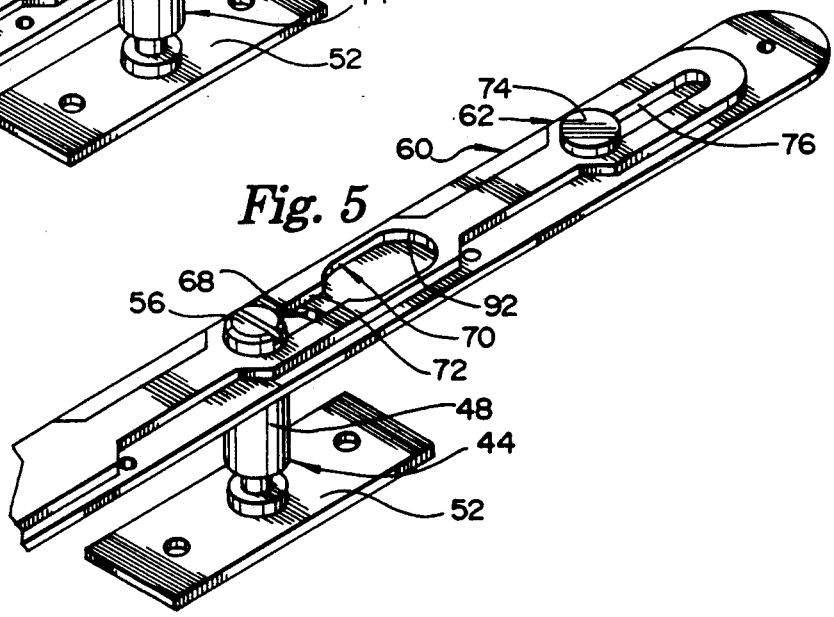
FIG. 5 is a view similar to FIGS. 3 and 4, but representative of a closed, locked disposition of the door panel.

FIGS. 3–5 illustrate the manner in which locking is accomplished by the movement of the second panel 62 relative to the first panel 60. FIG. 3 illustrates a position of the second panel 62 relative to the first wherein a widened portion of the aperture in the second panel is registered with an aperture in the first panel. As best seen in FIG. 3, said widened portion 92 of the aperture 70 in the second panel 62 is shaped and sized substantially the same as the aperture 68 in the first panel 60. As seen in FIG. 3 also, the aperture 70 in the second panel 62 has a narrowed portion 72 also.

This narrowed portion 72 is of a dimension so that, when the second panel 62 is moved to a position wherein the narrowed portion 72 becomes registered with the aperture 68 in the first panel 60, if an expanded head portion 56 of a locking boss 44 is in position through the registered apertures 68, 92 and behind the second panel 62, the narrowed portion 72 of the aperture 70 in the second panel 62 will preclude withdrawal of the locking boss 44.

FIG. 4 illustrates a configuration wherein the widened portion 92 of the aperture 70 in the second panel 62 is still in registration with the aperture 68 in the first panel 60. This figure, however, illustrates the locking boss 44 having passed through the registered apertures to dispose the expanded head portion 56 rearwardly of the second panel 62. FIG. 4 is representative of a situation wherein a sliding door panel 26 has been moved to a closed disposition but wherein the door 20 is not locked.

FIG. 5 illustrates and is representative of the same position of the door panel 26 as in FIG. 4. That is, the door panel 26 is in a closed disposition. In FIG. 5, however, the cam 82 has been actuated to move the second panel 62 relative to the first panel 60 so that the narrowed portion 72 of the aperture 70 in the second panel 62 has become registered with the aperture 68 in the first panel 60, the narrowed portion 72 of the aperture 70 in the second panel 62 having moved in front of the expanded head portion 56 of the locking boss 44 to constrain the locking boss 44 and preclude its retraction from the recess 58 formed in the door panel 26.

Figure 6:
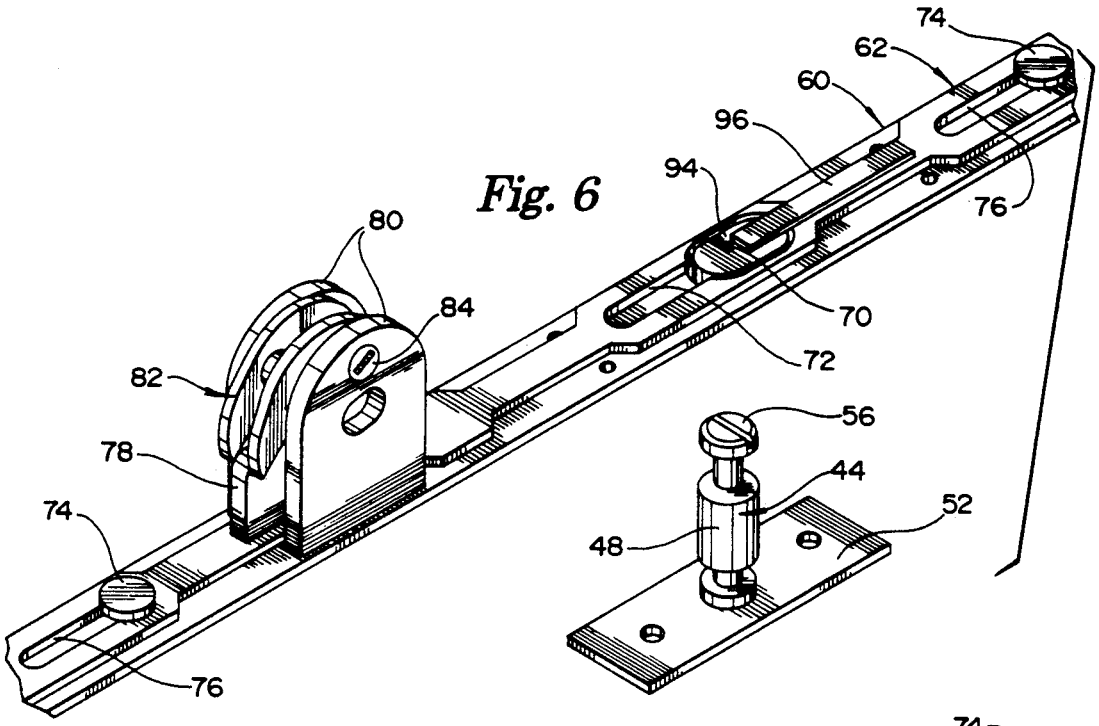
FIG. 6 is a view similar to FIG. 3 illustrating a safety device in a configuration wherein the door panel is in an open disposition.
Figure 7:
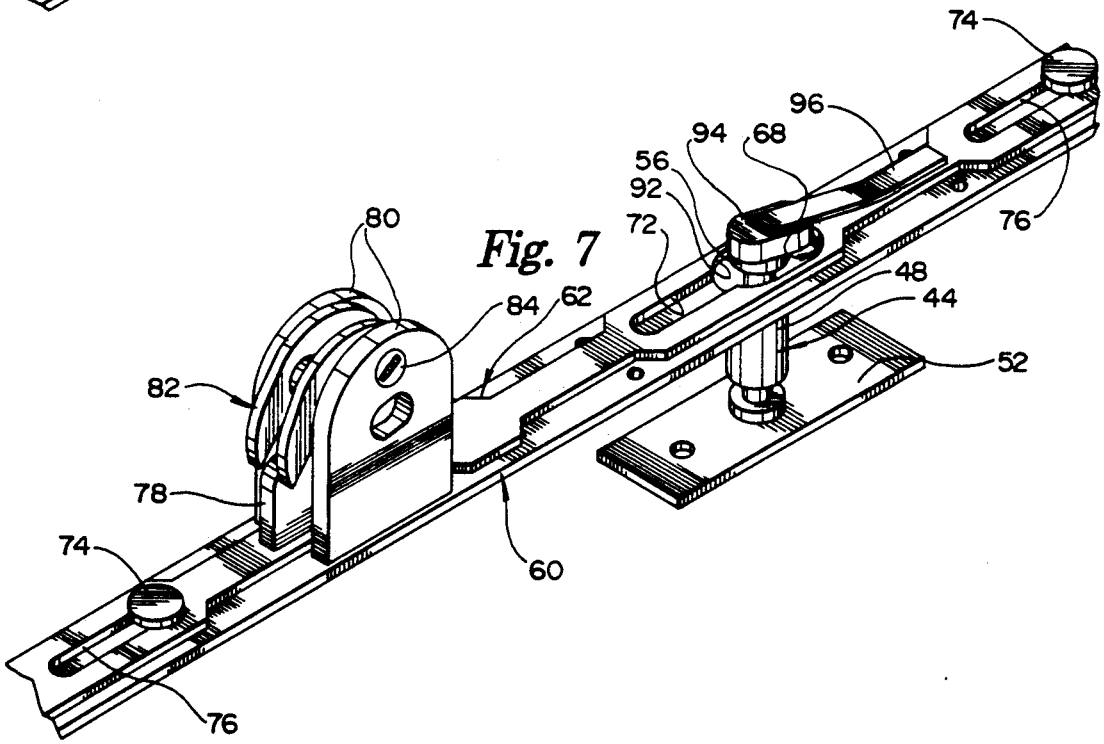
FIG. 7 is a view similar to FIG. 6, but wherein the door panel has been moved to a closed, unlocked disposition.
Figure 8:
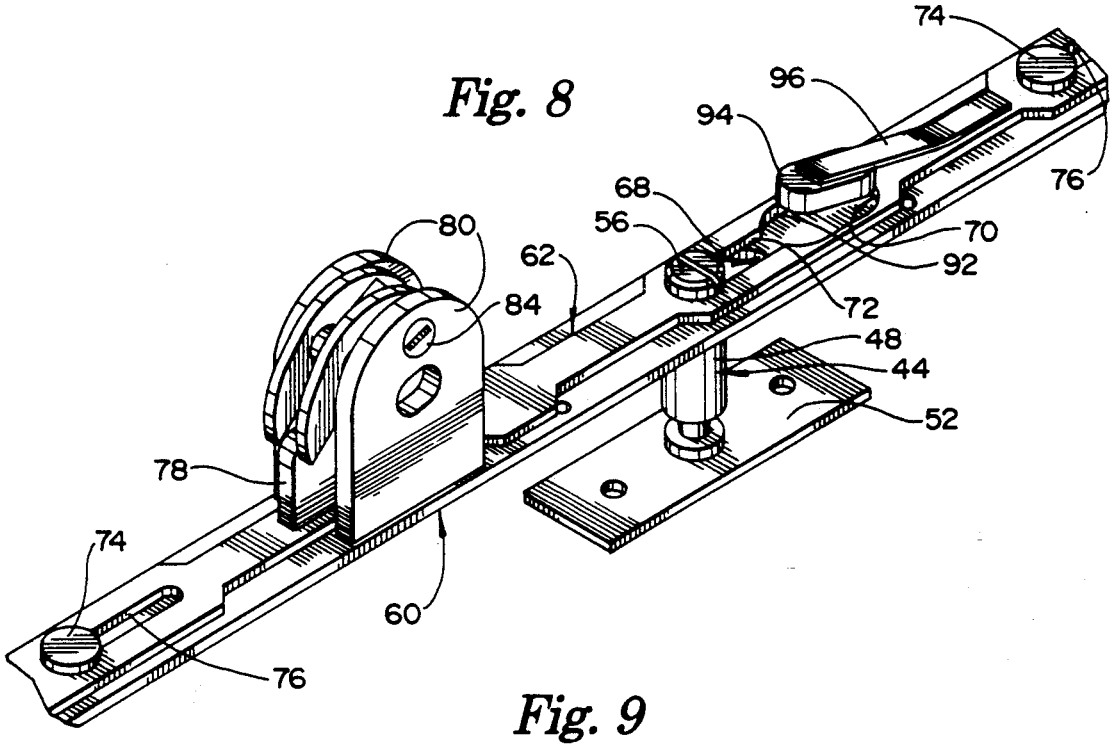
FIG. 8 is a view similar to FIGS. 6 and 7, but with the door panel in a closed, locked disposition.

FIGS. 6–8 illustrate positive means for inhibiting the occasioning of damage to the second panel 62 as a result of the door panel 26 being moved to its closed disposition when the second panel 26 mounted within the recess 58 of the door panel stile 30 is in a position wherein the narrowed portion 72 of the aperture 70 in the second panel 62 is registered with the aperture 68 in the first panel 60. As previously discussed, the widened portion 92 of the aperture 70 in the second panel 62 is shaped and sized substantially the same as the aperture 68 in the first panel 60. FIGS. 6–8 illustrate a plug 94 which is given substantially the same size and shape.

In FIG. 6, the plug 94 is disposed within the registered aperture 68 in the first panel 60 and widened portion 92 of the aperture 70 in the second panel 62. The plug 94 is biased to the position shown in FIG. 6 from the back side of the second panel 62 by means of a leaf spring structure 96. As long as the aperture 68 in the first panel 60 is in registration with the widened portion 92 of the aperture 70 in the second panel 62 and no act has been performed to urge the plug 94, against its bias, out of the position in a location in the registered apertures 68, 92, the plug 94 will preclude movement of the second panel 62 relative to the first panel 60.

FIG. 7 illustrates and orientation of components representative of when the door panel 26 has been slid to its closed disposition. As seen in FIG. 7, when this occurs, the locking boss 44 will have passed through the registered aperture 68 in the first panel 60 and widened portion 92 of the aperture 70 in the second panel 62, engaged the plug 94, and urged the plug 94, against its bias, out of the position illustrated in FIG. 6. With the plug 94 no longer in position to preclude relative movement of the second panel 62 with respect to the first 60, the cam 82 can be rotated to effect movement of the panel 62 to a location wherein the narrowed portion 72 of the aperture 70 in the second panel 62 becomes registered with the aperture 68 in the first panel 60 and "captures" the expanded head portion 56 of the locking boss 44 within the recess 58 of the sliding door panel 26.

As seen in FIG. 8, when the second panel 62 is moved to a position wherein the narrowed portion 72 of the aperture 70 therein is in registration with the aperture 68 in the first panel 60, the plug 94 rides up on the first panel 60. Because of the leaf spring mounting, the plug 94 becomes titled at an angle. Consequently, as the second panel 62 is moved to its original position, as illustrated in FIGS. 6 and 7, the plug 94 will "ramp up" on the expanded head portion 56 of the locking boss 44. Consequently, there should be no obstruction to movement of the second panel 62 relative to the first panel 60 in either direction.

Figure 12:
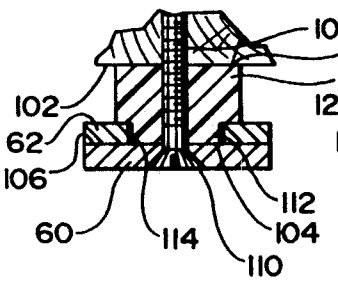
FIG. 12 is a fragmentary sectional view taken generally along line 12—12 of FIG. 10.

Referring now to FIGS. 10–12, a second embodiment of locking hardware is illustrated. It will be noted that, in appearance, the embodiment is quite similar to that illustrated in FIG. 2. Rather than employing button headed standoffs 74, however, to mate the second panel 62 to the first panel 60, a plurality of button blocks 98 are employed. One will additionally note, upon closer observation, that the plug 94 employed for minimizing the possibility of the door panel 26 being brought into its closed disposition when the second panel 62 is in a position wherein the narrowed portion 72 of the aperture 70 therein is in registration with the aperture 68 in the first panel 60 is not present. Rather, in this embodiment, structure for accomplishing such a goal is incorporated within the tab/dowel/ear/cam assembly. In this embodiment though, locking is still effect by movement of the second panel 62 relative to the first panel 60 to dispose the narrowed portion 72 of an aperture 70 in the second panel 62 in registration with the aperture 68 in the first panel 60. FIG. 12 illustrates the manner in which the button blocks 98 function to mount the first and second panels 60, 62 relative to one another. An inner surface 100 of each button block 98 is in engagement with the bottom 102 of the channel 40 defined within the edge of the slidable door panel 26. An outer surface 104 is in engagement with an inner face 106 of the first panel 60. A fastener such as a screw 108 having a counter-sunk head 110 passes through the first panel 60, the button block 98, and into the bottom 102 of the door panel channel 40. A narrowed portion 112 of the button block 98 passes through a corresponding aperture 114 in the second panel 62. Free sliding in reciprocal, longitudinal movement is, thereby, enabled. FIGS. 13 and 14 illustrate the tab/dowel/ear/cam assembly in accordance with the embodiment. FIG. 13 illustrates the assembly in an orientation wherein the second panel 62 is in its first position wherein the widened portion 92 of the aperture 70 formed therein is in registration with the aperture 68 in the first panel 60. FIG. 14 illustrates a disposition wherein the narrowed portion 72 of the aperture 70 in the second panel 62 is in registration with the aperture 68 in the first panel 60.

It is pointed out that the construction of the overall assembly is similar to that employed in the first locking hardware embodiment. The cam 82 has a generally radially-extending slot 88 formed therein, the slot 88 disposed to receive therein the dowel 86 mounted to the tab 78 and extending generally transverse to a plane defined by the tab 78. The cam 82 is mounted to a shaft 116 journalled between the two ears 80, one end of the shaft 116 being provided with a tumbler slot 84 to receive a key mounted at the end of an operating handle. As the operating handle is turned, therefore, the tumbler slot 84 will be rotated as will, in turn, the cam 82. As the cam 82 is rotated, the dowel 86, tab 78, and second panel 62 will be driven to dispose those components in desired orientations.

Two major differences, however, exist in this embodiment. The slot 84, proximate an outer peripheral surface of the cam 82, is provided with a concave profile 118 along one side of the slot 88. The profile 118 generally conforms to an outer surface of the dowel 86. Further, a flat spring 120 is hooked, at one end, to an anchor pin 122 carried by the cam 82. The spring 120 then passes around the axis of rotation of the cam 82 and to a corner 124 of the tab 78, engaging the tab corner 124 so that, as the cam 82 is rotated to an orientation where the dowel 86 is approaching exiting of the slot 88 formed in the cam 82, the dowel 86 will be urged into the concave profile 118 defined in the cam 82. Release of the operating handle will allow the spring 120 to drive and hold the dowel 86 into the profile 118 unless the handle is, volitionally, pivoted to effect rotation of the cam 82 wherein the dowel 86 will be made to pop out of the profile 118 and run radially inwardly within the slot 88 of the cam 82 as the cam 82 is rotated. As will be able to be seen then, in view of this disclosure, the combination and cooperation of the dowel 86 and concave profile 118 will enable maintenance of the second panel 62, relative to the first panel 60, wherein the widened portion 92 of the aperture 70 in the second panel 62 is registered with the aperture 68 in the first panel 60. This will be true even if the operating handle is released.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is:

1. Apparatus for locking closed a sliding door panel, comprising:

(a) a jamb-engaging stile which, when the panel is in a closed disposition, it is received within a channel defined by frame members comprising a jamb;

(b) at least one locking boss received within the channel and recessed wherein, when the panel is in an open disposition, said boss does not protrude out of the channel beyond the frame members defining the jamb;

(c) means, carried by the jamb-engaging stile, for capturing said locking boss when the panel is in a closed disposition to preclude opening lateral movement of the door panel;

(d) wherein a service of said jamb-engaging stile facing the jamb has a recess formed therein and said locking boss has an expanded portion at a distal end thereof, said capturing means comprising:

(i) a vertically-elongated first panel, having inner and outer surfaces, closing said recess, said first panel having an aperture, in alignment with said locking boss, formed therein through which said locking boss passes as the panel is moved to a closed disposition;

(ii) a vertically-elongated second panel, having inner and outer surfaces, received within said recess and disposed generally with said outer surface thereof against said inner surface of said first panel for reciprocation between first and second positions, said second panel having an aperture formed therein, said aperture formed in said second panel including a widened portion, through which said expanded portion of said locking boss can pass, in registration with said aperture in said first panel when said second panel is in said first position thereof, and a narrowed portion, through which said expanded portion of said locking boss is precluded from passing, in registration with said aperture in said first panel when said second panel is in said second position thereof; and (iii) means for moving said second panel between said first and second positions thereof;

(e) wherein said aperture formed in said first panel and said widened portion of said aperture formed in said second panel are substantially the same size and shape;

(f) a plug, substantially the same size and shape as said aperture formed in said first panel and said widened portion of said aperture formed in said second panel; and (g) means biasing said plug outwardly, when said second panel in is said first position thereof, through the registered widened portion of said aperture in said second panel and said aperture in said first panel to preclude relative movement of said second panel relative to said first panel.

2. Apparatus for locking closed a sliding door panel, comprising:

(a) a jamb-engaging stile which, when the panel is in a closed disposition, it is received within a channel defined by frame members comprising a jamb;

(b) at least one locking boss received within the channel and recessed wherein, when the panel is in an open disposition, said boss does not protrude out of the channel beyond the frame members defining the jamb;

(c) means, carried by the jamb-engaging stile, for capturing said locking boss when the panel is in a closed disposition to preclude opening lateral movement of the door panel;

(d) wherein a service of said jamb-engaging stile facing the jamb has a recess formed therein and said locking boss has an expanded portion at a distal end thereof, said capturing means comprising:

(i) a vertically-elongated first panel, having inner and outer surfaces, closing said recess, said first panel having an aperture, in alignment with said locking boss, formed therein through which said locking boss passes as the panel is moved to a closed disposition;

(ii) a vertically-elongated second panel, having inner and outer surfaces, received within said recess and disposed generally with said outer surface thereof against said inner surface of said first panel for reciprocation between first and second positions, said second panel having an aperture formed therein, said aperture formed in said second panel including a widened portion, through which said expanded portion of said locking boss can pass, in registration with said aperture in said first panel when said second panel is in said first position thereof, and a narrowed portion, through which said expanded portion of said locking boss is precluded from passing, in registration with said aperture in said first panel when said second panel is in said second position thereof; and (iii) means for moving said second panel between said first and second positions thereof;

(e) wherein said moving means comprises:

(i) a tab extending from said inner surface of said second panel generally perpendicular thereto to define a plane generally parallel to an axis of elongation of said second panel, said tab mounting, generally transverse thereto, a dowel;

(ii) an ear extending from said inner surface of said first panel generally perpendicular thereto to define a plane generally parallel to said plane defined by said tab;

(iii) a cam mounted to said ear for rotation about an axis spaced from said inner surface of said second panel at a distance different than that at which said dowel is spaced from said inner surface of said second panel, said cam having a generally radially-extending slot formed therein, said dowel being received within said slot, wherein, as said cam is rotated, said dowel rides radially within said slot to drive said second panel longitudinally relative to said first panel; and (iv) means for effecting rotation of said cam.

3. Apparatus in accordance with claim 2 wherein one side of said slot at an outer peripheral surface of said cam, has a concave profile, generally conforming to an outer surface of said dowel, formed therein, and further comprising means orienting said cam relative to said ear, said tab, and said dowel so that, when said dowel is cradled within said concave profile, said second panel will be positioned longitudinally relative to said first panel so that said aperture formed in said first panel is registration with said widened portion of said aperture formed in said second panel.

* * * * *